United States Patent [19]

Jasinski

[11] 4,091,564

[45] May 30, 1978

[54] WHEEL AND CONTROL STICK ENABLING TURNING AND TILTING THEREOF

[76] Inventor: Irving R. Jasinski, 3737 Foxley Dr., Escondido, Calif. 92027

[21] Appl. No.: 694,846

[22] Filed: June 10, 1976

[51] Int. Cl.[2] ..... A63H 33/02

[52] U.S. Cl. ..... 46/220; 273/126 R

[58] Field of Search ..... 46/220, 114; 273/126 R

[56] References Cited

U.S. PATENT DOCUMENTS

| | | | |
|---|---|---|---|
| 480,619 | 8/1892 | Park | 46/220 |
| 3,346,990 | 10/1967 | Holt | 46/220 UX |
| 3,660,929 | 5/1972 | Atkinson | 46/220 X |
| 3,785,652 | 1/1974 | Ghovanloo | 46/220 |

*Primary Examiner*—F. Barry Shay

*Attorney, Agent, or Firm*—Robert C. Comstock

[57] ABSTRACT

A toy wheel comprising an elongated control stick having a control head at its lower end which is adapted to removably engage the periphery of a wheel. The control head is adapted to be positioned substantially any place along the periphery of the wheel. The control head has a pair of parallel side plates which extend a substantial distance inwardly from the periphery of the wheel on opposite sides thereof. A semi-circular disc disposed between the inner ends of the side plates engages the periphery of the wheel. The control stick is movable in any direction to change the direction of movement of the wheel and is tiltable at any angle up to 45° from vertical. Directional and angular changes can be made without losing control of the wheel and without substantial frictional engagement between the control head and wheel.

3 Claims, 7 Drawing Figures

FIG. 2.
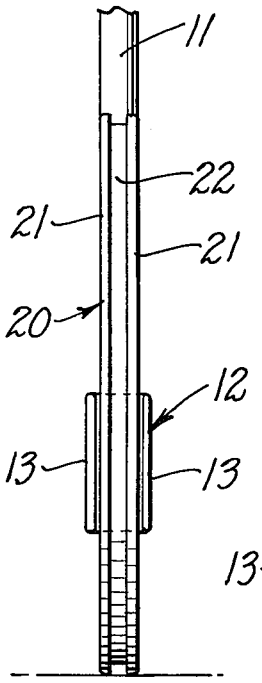
FIG. 3.
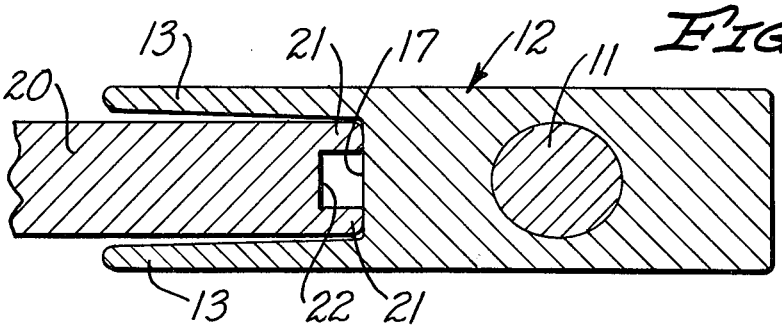
FIG. 4.
FIG. 1.
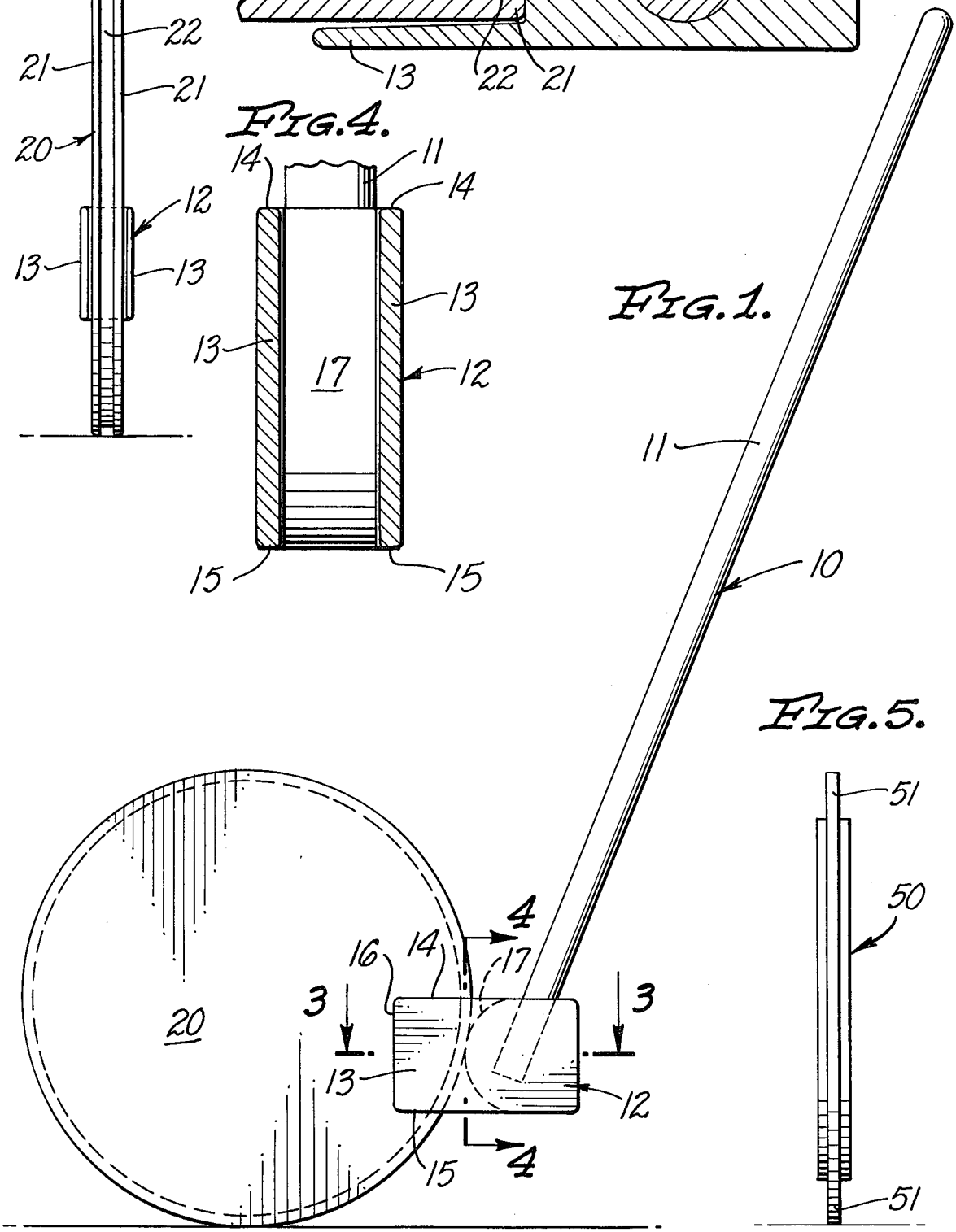
FIG. 5.

FIG. 6.
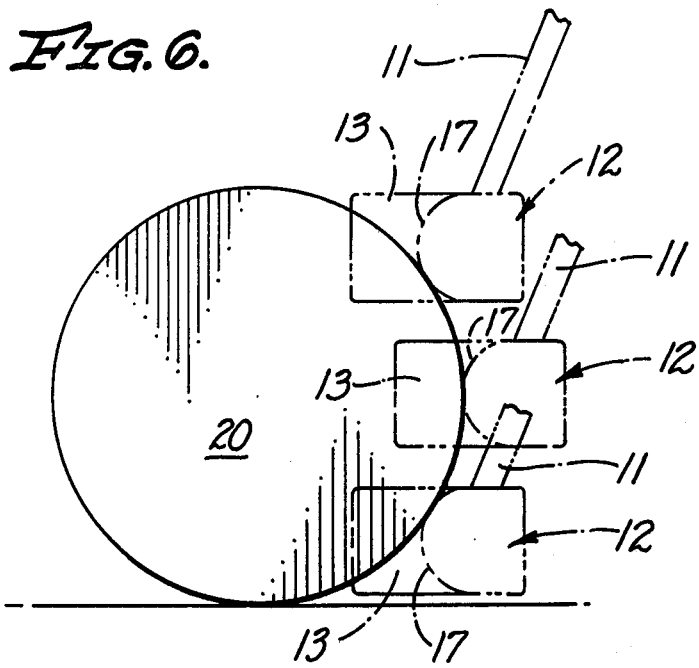
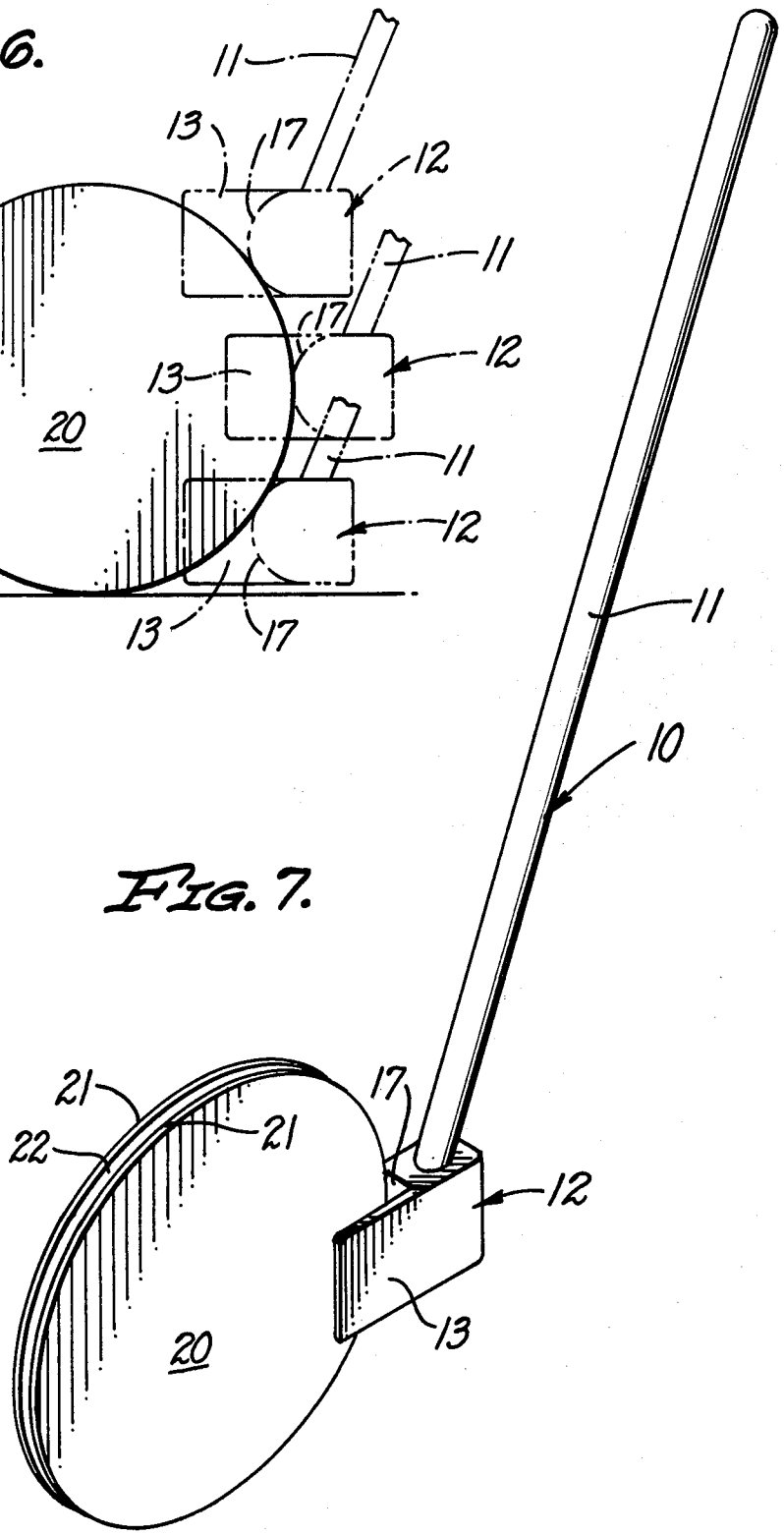
FIG. 7.

WHEEL AND CONTROL STICK ENABLING TURNING AND TILTING THEREOF

BACKGROUND OF THE INVENTION

1. Field of the Invention:

The invention relates to a toy wheel in which a wheel is propelled along the ground or other surface by a hand-held control stick.

2. Description of the Prior Art:

The prior art discloses numerous forms of toy wheel devices. U.S. Pat. No. 3,715,834, for example, discloses one in which the wheel has a pair of sharply pointed flanges which fit extremely loosely within a pair of spaced grooves carried by the control stick. In U.S. Pat. No. 2,970,403, the wheel engages a rotatably mounted roller carried by the control stick and the stick has a pair of spaced prongs which must be separated in order to disconnect the wheel from the stick. U.S. Pat. No. 3,785,652 discloses a device in which the stick is rotatably connected to a pair of spaced guide wheels which engage the ground simultaneously with the wheel portion of the toy.

The prior art devices have in common the fact that they do not provide sufficient simply executed control of the wheel to permit it to be moved through a variety of angular positions and directions without the operator losing control of the wheel. Prior devices are also in many cases unnecessarily complicated in their structure, having various numbers of moving parts.

Previous devices of this type have been made in such a manner that the user quickly lost interest in the toy because of its lack of versatility in performance characteristics. Prior devices did not allow a substantial degree of sideward tipping of the wheel, nor did they allow very abrupt directional changes at high speeds. They also did not provide the capability of shuttling the wheel back and forth between two control sticks without the wheel falling sideways to the ground.

SUMMARY OF THE INVENTION

The primary object of the present invention is to provide a toy wheel which is extremely simple in its structure and operation. It requires no maintenance or repairs and is accordingly long lasting. The wheel can be easily moved through an almost unlimited number of variations in direction and angular positioning without the operator losing control or the wheel falling.

Because of the wide surfaces of the control stick head which engage the sides of the wheel, the wheel can be rolled under complete control at any angle up to 45° to either side from vertical.

The wheel can be turned abruptly in a right angular direction while in motion at fast speed, up to 3 miles per hour.

The toy has the capability of reversing the direction of movement of the wheel within 6 inches of travel.

An upward thrust movement of the control stick or head is not required, merely a continuous forward motion at substantially any point along the circumference of the wheel.

The control stick can contact the wheel and hold it motionless in an upright position when the wheel is propelled toward it by another control stick. The wheel can be braked from high speeds by merely reversing the direction of the control stick.

In an alternative embodiment, the wheel is designed to travel through sand or other soft material with a minimum amount of frictional resistance.

The invention also comprises such other objects, advantages and capabilities as will later more fully appear and which are inherently possessed by the invention.

While there are shown in the accompanying drawings preferred embodiments of the invention, it should be understood that the same are susceptible of modification and change without departing from the spirit of the invention.

DESCRIPTION OF THE DRAWINGS

FIG. 1 is a side elevational view of the control stick and wheel in use;

FIG. 2 is a front elevational view of the same;

FIG. 3 is an enlarged sectional view taken on line 3—3 of FIG. 1;

FIG. 4 is an enlarged sectional view taken on line 4—4 of FIG. 1;

FIG. 5 is a front elevational view of an alternative embodiment of wheel for use in sand;

FIG. 6 is a side elevational view of the wheel in use, with alternative positions of the head shown in phantom lines;

FIG. 7 is an isometric view of the complete toy in use.

DESCRIPTION OF THE PREFERRED EMBODIMENT

A first preferred embodiment which has been selected to illustrate the invention comprises an elongated control stick 10 which includes an elongated handle 11. The handle 11 has an upper free end which may be provided with a hand grip for holding the control stick 10 when the stick is in use. The lower end of the handle 11 is rigidly attached to a control head 12.

The head 12 has a pair of spaced parallel side plates 13 having top and bottom edges 14 and 15, which are preferably slightly tapered and rounded. The vertically directed forward edge 16 is preferably tapered somewhat more than the top and bottom edges 14 and 15.

Disposed between the side plates 13 is a semi-circular disc 17 which extends across the entire distance between the side plates 13 adjacent their longitudinal midportion. The surface of the disc 17 is preferably smooth.

The handle 11 preferably extends upwardly at an angle of approximately 25° with respect to vertical. The head 12 is preferably rectangular in shape, with straight parallel sides. The corners of the head 12 are preferably rounded, particularly at the forward open corners where the head 12 comprises only the side plates 13.

The control stick 10 is designed and adapted for use in combination with a circular wheel 20. The periphery of the wheel 20 preferably comprises a pair of spaced parallel flanges 21 which are separated by a recess 22. The outer side edges of the flanges 21 are preferably somewhat rounded.

The thickness of the periphery of the wheel is only slightly less than the width of the space between the inner surfaces of the side plates 13 adjacent to the disc 17. The clearance between these surfaces is preferably approximately ⅛ inch. Because of the outward tapering and rounding of the side plates 13, the clearance is slightly greater adjacent to the vertical edges 16 of the side plates 13. This structure provides a slight wedging effect when the side plates 13 fit around the periphery of the wheel 20.

In use, the head 12 of the control stick 10 is adapted to fit around the periphery of the wheel 20 at substantially any vertical position from adjacent to the ground to adjacent the top of the wheel. As the control stick 10 is moved in a horizontal direction (no upward movement is required), the wheel 20 is carried with it. The direction of movement and angle with respect to the ground of the wheel 20 can be changed immediately in response to movement of the handle 11 and head 12. The stick 10 and wheel 20 move together as if they were attached to each other.

The range of angular movement of the wheel 20 is at least 90° (45° to either side) and the degree of directional change is unlimited. The wheel 20 can be abruptly moved at a right angle in either direction and its direction of movement can also be reversed.

The wheel 20 can be shuttled back and forth from one control stick 10 to another since it can be caught between the side plates 13 of the head 12. It can be moved through all of the various maneuvers set forth earlier in this specification and almost any other conceivable maneuver without the control stick losing control of the wheel or dropping the wheel. Because the degree of control and the maneuverability are both practically unlimited, the play possibilities are likewise virtually unlimited. One playing with the toy accordingly will not lose interest because of the failure of the toy to perform or because of its inherent limitations.

It should be noted that neither the control stick 10 nor the wheel 20 has any moving parts. They may be conveniently and economically formed of wood, plastic or other suitable material.

Because all of the surfaces which engage the ground or which engage the other component of the toy are smooth and rounded, friction is reduced to a minimum and there is little likelihood of personal injury.

A second preferred embodiment of the invention is shown in FIG. 5 of the drawings. Either the same or a modified control stick 10 may be used, but the alternative wheel 50 is particularly designed for use in sand and on other soft surfaces. The wheel 50 is provided around its periphery with a single central thin outwardly directed flange 51, which is adapted to make minimal frctional contact with sand or the like. The flange 51 preferably extends a substantial distance radially beyond the remainder of the wheel 50.

When the wheel 50 is in use, the flange 51 is the only portion of the wheel 50 which extends into the sand, the remainder of the wheel being disposed above and free from frictional engagement with the sand.

I claim:

1. A toy device comprising a wheel and a control stick separate from said wheel, both said wheel and control stick having no moving parts, said control stick having a free upper end adapted to be gripped by the hand of a user, the lower end of said control stick being attached to a substantially rectangular control head, said control head having a pair of spaced side plates, said head having a semi-circular disc disposed between said side plates and presenting a convex surface located adjacent to the longitudinal midportion of said head, said wheel having a peripheral width only slightly less than the distance between said side plates adjacent to said disc, said handle extending at an angle from vertical with respect to said control head so that when said handle is held by a user in standing position, said control head extends substantially parallel to the ground and transversely with respect to said wheel, said control head being of a vertical dimension rendering it vertically movable in a manner to allow said convex surface to engage substantially any portion along the periphery of said wheel from adjacent to the ground to adjacent to the top of said wheel, said side plates extending a substantial distance inwardly from the periphery of said wheel closely adjacent to, but free from substantial frictional engagement with the sides of said wheel, so that as said disc engages substantially any portion along the periphery of said wheel, said control stick is movable in any direction to change the direction of movement of said wheel throughout a directional range of 360°, said control stick being simultaneously tiltable to any angle up to 45° from vertical to either side to change the angle of said wheel with respect to the ground, both of said changes of direction of movement and tilt of said wheel being made without said wheel falling over or said control stick losing control of said wheel and without interfering with the free rotation of said wheel within said control head, said wheel being freely movable at all times in and out of said control head.

2. The structure described in claim 1, the inside surfaces of both of said side plates being smoothly tapered from adjacent to said disc to adjacent said front edge to provide a slight wedging effect between said side plates and said wheel.

3. The structure described in claim 1, said wheel having around the periphery thereof a thin disc which extends radially outwardly a substantial distance beyond the remainder of said wheel, said disc being adapted to move through sand with minimal frictional engagement therewith, while the remainder of said wheel is out of engagement with the sand.

* * * * *